US006827255B2

(12) United States Patent
Jenkins et al.

(10) Patent No.: US 6,827,255 B2
(45) Date of Patent: Dec. 7, 2004

(54) LASER-OPERATED SECURITY MAILBOX

(76) Inventors: Mary E. Jenkins, 2131 Hycroft Dr., Pittsburgh, PA (US) 15241; Robert J. Jenkins, III, 3175 Sonja Way, Mt. Pleasant, SC (US) 29466

( * ) Notice: Subject to any disclaimer, the term of this patent is extended or adjusted under 35 U.S.C. 154(b) by 52 days.

(21) Appl. No.: 10/420,095

(22) Filed: Apr. 22, 2003

(65) Prior Publication Data

US 2004/0211826 A1 Oct. 28, 2004

(51) Int. Cl.[7] ..... B65D 91/00

(52) U.S. Cl. ..... 232/29; 232/17; 232/38; 232/45

(58) Field of Search ..... 232/17, 29, 33, 232/45, 38

(56) References Cited

U.S. PATENT DOCUMENTS

| | | | | | |
|---|---|---|---|---|---|
| 1,139,491 | A | * | 5/1915 | Coon | 232/39 |
| 2,945,621 | A | * | 7/1960 | Kopprasch et al. | 232/24 |
| 3,107,848 | A | * | 10/1963 | Penta | 232/17 |
| 3,606,140 | A | * | 9/1971 | Shannahan | 232/17 |
| 4,154,393 | A | | 5/1979 | Darvishian | |
| 4,244,512 | A | | 1/1981 | Wise | |
| 5,239,305 | A | | 8/1993 | Murphy | |
| 5,271,555 | A | * | 12/1993 | Mayer | 232/17 |
| 5,377,906 | A | | 1/1995 | Mason | |
| 5,425,501 | A | | 6/1995 | Wesorick | |
| D376,891 | S | * | 12/1996 | Wooten et al. | D99/31 |
| 5,775,578 | A | * | 7/1998 | Baxi et al. | 232/17 |
| 5,954,264 | A | | 9/1999 | Keller | |
| D450,418 | S | * | 11/2001 | Belt | D99/29 |
| 6,474,543 | B2 | * | 11/2002 | Grell | 232/38 |

* cited by examiner

*Primary Examiner*—William L. Miller
(74) *Attorney, Agent, or Firm*—McKay & Associates, PC

(57) ABSTRACT

The present invention relates to a security mailbox. The mailbox includes an inner and an outer sleeve which are slidably engaged with one another. Each sleeve has an alternating pattern of an opaque portion and a transparent portion. When the transparent portions are aligned with one another, the user is able to view the contents of the mailbox. The mailbox additionally includes a remote control for activating the power source, which slides the inner sleeve underlying the outer sleeve. In combination with a latch mechanism, this remote control also enables the user to open the mailbox door from a considerable distance away.

18 Claims, 14 Drawing Sheets

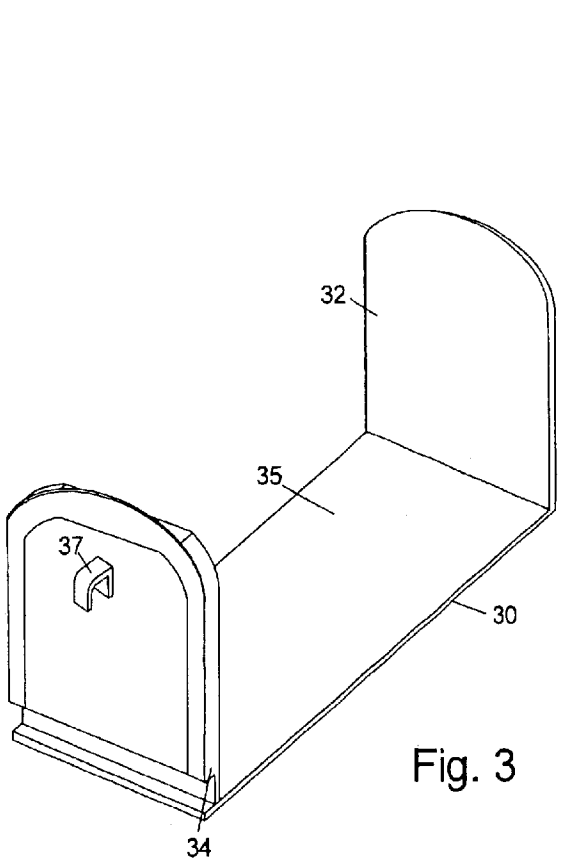
Fig. 3
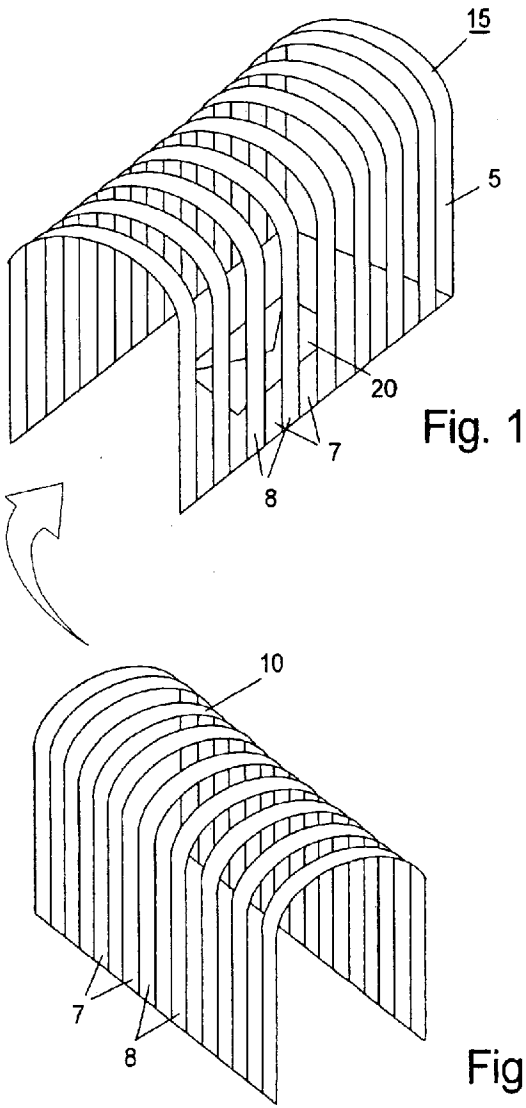
Fig. 1
Fig. 2

Photo Circuit

Note:
Point x is a function of the variable resistor setting, thus sensitivity of circuit is adjustable.

| Input | Switch | Output1 | Output2 |
|---|---|---|---|
| L | C | L | L |
| H | – | H | L |
| L | O | L | H |

| Input 1 | Input 2 | Output 1 | Output 2 |
|---|---|---|---|
| L | L | L | L |
| H | L | +5v | Gnd |
| H | H | Forbidden! | |
| L | H | Gnd | +5v |

Photo Circuit

Note:
Point x is a function of the variable resistor setting, thus sensitivity of circuit is adjustable.

Toggle Circuit

| Input 1 | Input 2 | Output 1 | Output 2 |
|---|---|---|---|
| L | L | L | L |
| H | L | +5v | Gnd |
| H | H | Forbidden! | |
| L | H | Gnd | +5v |

LASER-OPERATED SECURITY MAILBOX

FIELD OF THE INVENTION

The present invention relates generally to mailboxes. In particular, a mailbox is disclosed which is configured to allow a user using a hand-held remote control to view the interior contents of the mailbox from a distance.

BACKGROUND OF THE INVENTION

Occasionally, a sense of apprehension is felt when users reach into voids in which the contents are relatively unknown. In the typical outdoor mailbox situated proximate to an easily accessible street or yard and away from the house, it is not uncommon to worry about potential pranksters and vandals leaving "gag" devices inside the mailbox. An unprotected housing that should only be used for mail may become a container holding contents of unknown origin. This may be the case since the typical mailbox is constructed of a solid metal or an opaque exterior housing, prohibiting the view of the interior and any contents therein. Thus, the only way to verify the contents of the mailbox is to reach inside, or open up the latched door and view the contents from the proximate location.

Furthermore, as a result of modern terror threats and other domestic "mail" bombers, it would be beneficial to be able to view, open, and confirm the contents of a mailbox from a remote location. Accordingly, there is a need in the art for a safe, worry-free mailbox which enables the owner to remotely view their mail within the mailbox and allow these same persons to open their mailboxes from a distance.

The following U.S. Patents show a variety of mailbox designs and types. U.S. Pat. No. 4,244,512 shows a mailbox that includes a transparent U-shaped main body capable of holding a picture. It allows the owner to display pictures or designs from inside the mailbox. This particular mailbox also includes a hinged door that can be opened by the owner. No automated means or remote control for opening the mailbox are included in this design.

U.S. Pat. No. 4,154,393 comprises a wall-mounting mailbox configured to deter prowlers from tampering with the owner's mail. This apparatus includes a lighting device and an alarm to protect the mail inside the mailbox, from theft or vandalism. The lighting feature of this invention also provides the user of the mailbox ease when picking up mail in a dim room, or in darkness. This invention is equipped with a sensor to detect the presence of prowlers in the vicinity of the mailbox, regardless of whether the prowlers touch the mailbox. Once a prowler is in the vicinity an alarm can be set off to notify the owner of the prowler. This invention does not provide the owner with any means of viewing the contents of the mailbox before its opening, nor are there any means for opening the mailbox from a distance by remote control.

U.S. Pat. No. 5,239,305 describes a mailbox that enables the user to be notified upon deposit of mail by the mail carrier. The invention is mainly directed towards rural areas where homes are located far from their corresponding mailboxes. This apparatus provides a reset mechanism for the user to reset the mail indicator from inside the household once mail has been deposited in the mailbox.

U.S. Pat. No. 5,377,906 also discloses a means for notifying the owner of a mailbox of the presence of mail within the mailbox. In this invention, a sensor is placed on the bottom of the inside container of the mailbox's main body. When mail covers this sensor the indicator is signaled and notifies the owner that mail is present.

U.S. Pat. No. 5,954,264 discloses a remote control, used by the mail carrier, for opening the mailbox door. This invention allows the mail carrier to open the mailbox before driving up to it and to close the mailbox door after driving away from it, using the remote control. It also provides an automated means of changing the position of the flag or mail indicator. This invention however, does not allow for the mail carrier or owner of the mailbox to view the contents of the mailbox before opening it.

U.S. Pat. No. 5,424,501 comprises a conventional mailbox with a solid U-shaped sleeve inside. This solid U-shaped sleeve is designed to be able to fit inside the U-shaped outer cover of a conventional mailbox. The said sleeve is able to be slid out of the outer cover by mail delivery persons when driving a car or mail truck on a rural route. The sleeve also protects the contents of the mailbox from the elements while in the extended position. No automated means for sliding the sleeve out of the outer cover are provided, nor are any means provided for viewing the mail before opening the mailbox door.

Thus, there is need in the art for a laser-operated security mailbox that enables the user to view the contents of the mailbox before opening it by utilizing a series of alternating, offset transparent and opaque areas on the inner and outer sleeves of the mailbox. The present invention includes a remote control for laser-operated, mechanical sleeve movement, allowing a user to determine the presence of any mail without subjecting themselves to any potential danger and even inclement weather.

SUMMARY OF THE INVENTION

The objective of the present invention is to provide a security mailbox to significantly reduce the risk of harm to an individual caused by the activation of an unwanted, dangerous piece of mail and to allow an individual to safely inspect the contents of the mailbox from a distance without having to open the mailbox door. One device when activated converts the mailbox from its normally opaque state to a partially transparent state, thus allowing one to see the contents inside the mailbox. The other device is designed to allow a person to open the mailbox door automatically from a significant distance from the mailbox. Thus, the two devices, in combination, allow the user to view the contents of the mailbox and remotely open the mailbox without the fear of harm from an unsuspecting act.

Accordingly, what is provided is a security mailbox having a base and a top cover mounted on the base, wherein the top cover further comprises an inner sleeve and an outer sleeve, each sleeve comprised of a major body portion having a pattern of alternating transparent and opaque areas, wherein the inner sleeve underlies the outer sleeve and is adapted to be displaced horizontally on the base such that the pattern of alternating transparent and opaque areas on the inner sleeve may respectively align with the pattern of alternating transparent and opaque areas of the outer sleeve to allow a partial view into an interior of the top cover; and a means for horizontally displacing said inner sleeve.

In the preferred embodiment, the security mailbox has a latch mechanism situated within a horizontal channel proximate to said door. It further has a latch release button extending through the horizontal channel comprising a cavity in a top thereof, a screw extending through the cavity, a pulley fixedly attached to the screw, a nut means disposed within the cavity encircling the screw, and a spring underlying the nut means within the cavity, wherein the latch release button is configured to move upwards in response to a force of the mailbox door as the spring is in a relaxed state when the nut means moves upwards upon rotation of the pulley.

BRIEF DESCRIPTION OF THE DRAWINGS

FIG. 1 is a perspective view of the outer sleeve.

FIG. 2 is a perspective view of the inner sleeve, which when coupled to the outer-sleeve, forms the top cover of the mailbox.

FIG. 3 is a perspective view of the base of the mailbox.

DETAILED DESCRIPTION OF THE PREFERRED EMBODIMENT

Figures 4, 5, 6:
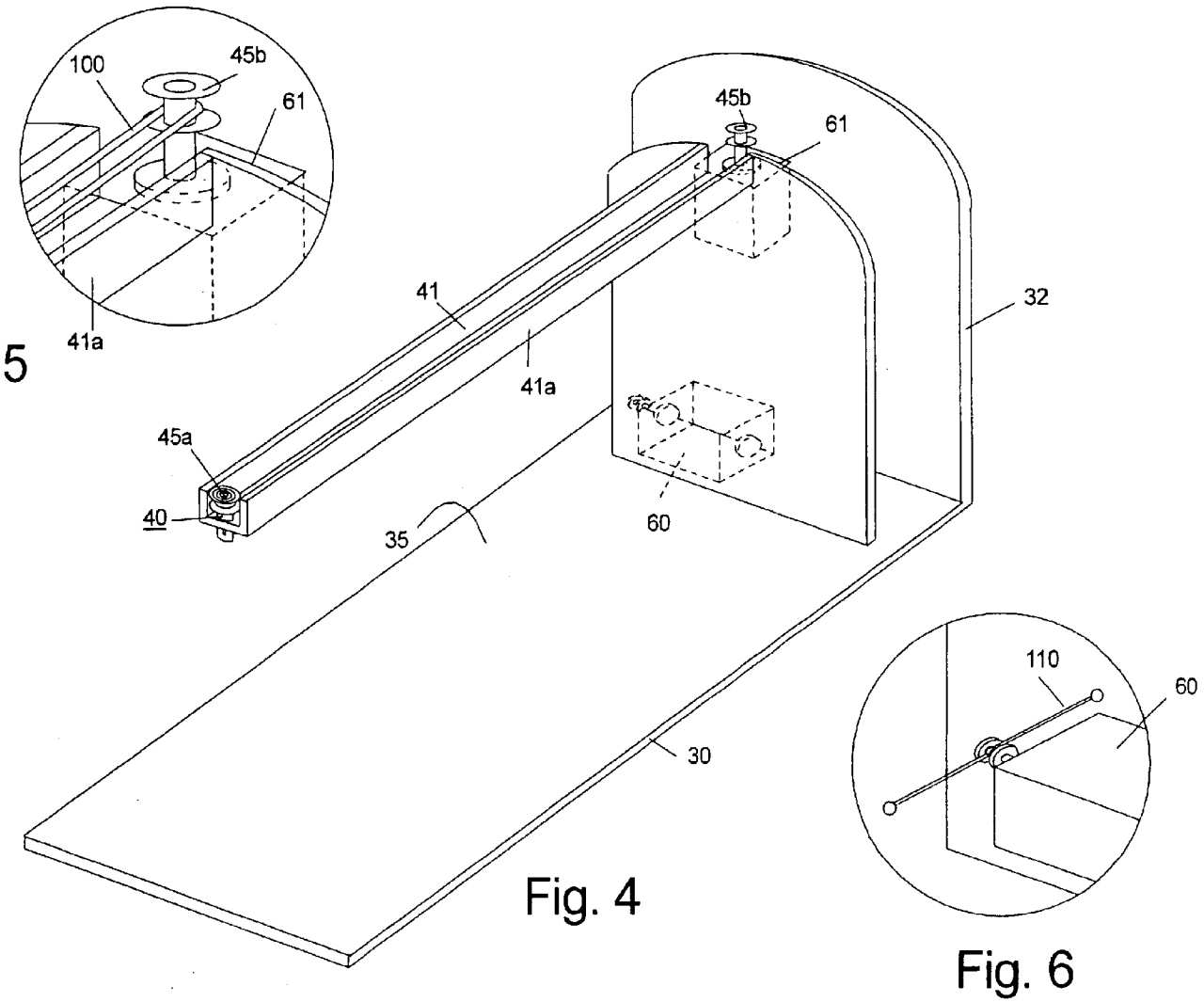
FIG. 4 is a perspective view of the interior of the mailbox showing the two actuators.
FIG. 5 is a blow-up of the actuator that releases the latching mechanism.
FIG. 6 is a blow-up of the actuator that is connected to the inner sleeve.

With reference then to FIGS. 1–21, the top cover 15 of the security mailbox 1 is constructed of two concentric sleeves, an outer sleeve 5 and an inner sleeve 10, with the inner sleeve 10 being slightly smaller than the outer sleeve 5. The sleeves 5 and 10 are preferably shaped in the form of a classic mailbox so that when viewed from the front (or rear), the shape of the top cover 15 is preferably an arch, though this shape may vary. Because the transparent sleeves 5 and 10 are concentric and the inner sleeve 10 is slightly smaller than the outer sleeve 5, it is possible for the inner sleeve 10 to slide within the outer sleeve 5. This inner sleeve 10 is further not as long as the outer sleeve 5, such that the inner sleeve 10 may be displaced horizontally with respect to the outer sleeve 5.

Each sleeve 5,10 is comprised of a major body portion having a pattern of a plurality of parallel, opaque and transparent areas applied to it in spaced relation thereto, whereby a pattern of alternating transparent areas 7 and opaque areas 8 is formed as part of each sleeve 5 and 10. The alternating transparent and opaque areas 7, 8 on both sleeves 5,10 are congruent such that the areas are of equal width, whereby the transparent area 7 or opaque area 8 on the inner sleeve 10 can respectively align with the transparent area 7 or opaque area 8 of the outer sleeve 5. Since the widths of the transparent and opaque areas 7,8 generally match on both the inner sleeve 10 and outer sleeve 5, in their starting offset position the two sleeves 5,10 can not be seen through, giving the appearance of a typical, opaque or metal mailbox. However, when the transparent and opaque areas 7,8 of the inner sleeve 10 and outer sleeve 5 are aligned upon activation and horizontal displacement of the inner sleeve 10, as will be further described, it is then possible to partially see through the vertically aligned transparent areas 7 and at least partially view the contents 20 of the interior 35 of the security mailbox 1.

FIG. 3 shows the base 30 of the mailbox 1. The base 30 includes a perpendicular back 32 that forms the rear of the security mailbox 1. A door 34 is hingedly attached to the front of the base 30. The door 34 may be opened manually or by remote control 75 as follows.

The circuits that operate the security mailbox 1 are enclosed on a control board 36 attached to the base 30 preferably situated in front and parallel to the perpendicular back 32 of the security mailbox 1 within its interior 35. There are two separate sensors and sensor ports 200*a* & 200*b* on the perpendicular back 32, which allow the electronics to detect a laser light signal received by either sensor port 200*a* or 200*b*.

The electronics adapted to allow for the movement of the inner sleeve 10 include two actuators. A first actuator 60 is connected to the inner sleeve 10 preferably behind the control board 36, and the second actuator 61 is connected to a latching mechanism 40 for the mailbox door 34, via a horizontal channel 41 defined by a rail 41*a* that travels along the inside top arch of the top cover 15. The door latch mechanism 40 is designed in such a way that in addition to the second actuator 61 being able to open the, door 34, pulling on the tab 37 connected to the front of the door 34 will also open the door 34, in a manner similar to a conventional mailbox.

The second actuator 61 that drives the latch mechanism 40 includes a small drive pulley 45*b* which is connected to the pulley 45*a* on the latch mechanism 40 by wires or another suitable linkage 100. There is a bead 151 attached to this linkage 100, which will close a lever-activated switch 150 (see FIG. 6*a*) when the latch mechanism 40 is fully locked.

The first actuator 60 that toggles the position of the inner sleeve 10 is attached via a wound wire, or wound flexible linkage 110, to the inside wall of the inner sleeve 10. As the first actuator 60 turns in one direction, it will move the sleeve 10 until the sleeve 10 is stopped by the inside edge of the mailbox 1. When the first actuator 60 turns in the other direction, it will move the inner sleeve 10 in the other direction until the inner sleeve 10 hits another stop (not shown). Any suitable abutment means may be used to prevent the inner sleeve 10 from escaping the outer sleeve 5.

Figure 7:
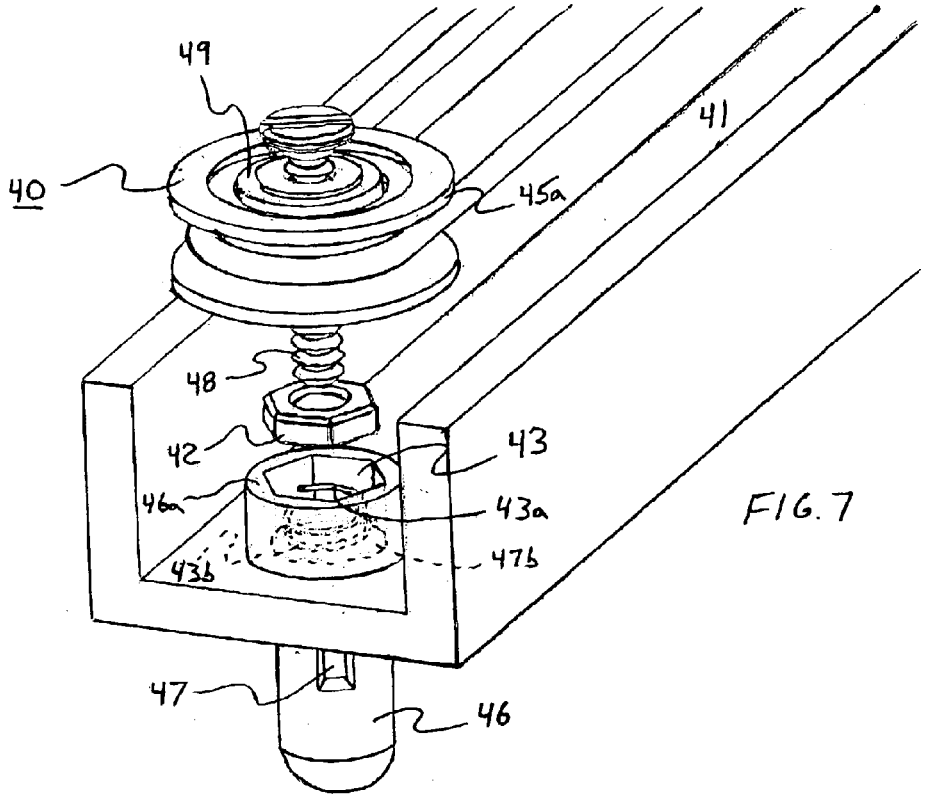
FIG. 7 is an exploded perspective view of the latch mechanism.
Figure 7A:
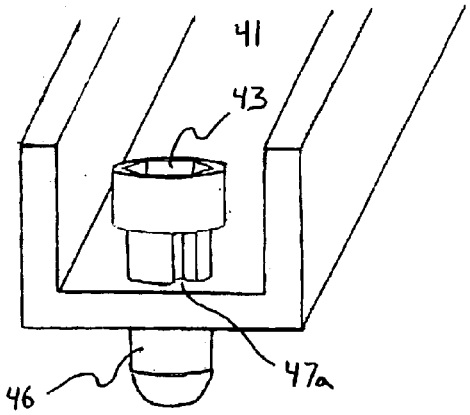
FIG. 7*a* is a perspective view of the latch release button in an up-position as if the door is releasing.
Figure 7B:
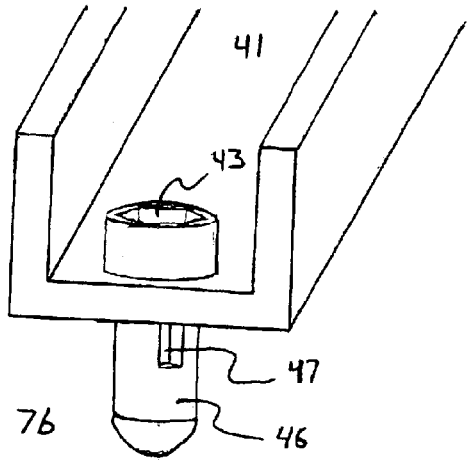
FIG. 7*b* is a perspective view of the latch release button in a down-position to hold the door in place.

The latch mechanism 40 can be seen in FIGS. 6*b*–7*b*. The latch release button 46 has a slot 47 and is held in place by at least one notch 47*a* (see FIG. 7*a*) built into the hole 47*b* at the bottom of the horizontal channel 41 through which the latch release button 46 travels. The notch 47*a*, fitting into the slot 47, permits the button to move vertically but not rotationally.

A nut means 42, or any other type of similar threaded bearing, is situated to remain, at all times, inside the hexagonal shaped cavity 43 of the latch release button 46, thereby holding the components of the latch mechanism 40 in place, concentrically with the latch release button 46. The nut means 42 moves up and down a screw 48 (within the cavity 43) inside the latch release button 46. The screw 48 is fixedly attached to the pulley 45*a* using a washer 49 (or similar type disc or grommet) and is situated to extend down through the interior of the latch release button 46. The screw 48 can not move up because the top of the screw is in contact with the inside of the mailbox inner sleeve 10. This configuration allows for the vertical travel of the nut means 42 upon rotation of the screw 48. The nut means 42 remains inside the similarly shaped, hexagonal cavity 43 such it will travel vertically without rotating as only the screw 48 rotates without vertical displacement.

There is a spring 43*a* situated within the cavity 43 underneath the bottom of the nut means 42, encasing the threaded screw 48. The pulley 45*a* will rotate with the screw 48 and move up and down only a small amount. As with the screw 48, the pulley's upward motion is also restricted by the inside top of the mailbox cover 15, and both the screw 48 and pulley's downward motion is limited by the force of the spring 43*a* and the top of the latch release button 46. Thus, when the pulley 45*a* is rotated, it will rotate the washer 49, which will resultantly rotate the screw 48 in the middle of the assembly. When the screw 48 is rotating in the direction that pulls the nut means 42 upwards, the spring 43*a* in the latch release button 46 will expand to its full length. At this point there will be no substantial force holding the latch release button 46 down, and the mailbox door 34 will open via gravity or a spring-loaded assist.

When the screw 48 is rotated in the other direction, it will push the nut means 42 towards the bottom of the button 46, thereby compressing the spring 43*a*. When there is no more room for the pulley 45*a* or nut means 42 to move, there will be a force pushing the latch release button 46 down. This downward force will prevent the lid from falling open, but because of the spring 43*a* inside the latch release button 46, it will still be possible for the user to manually open or close the mailbox door 34, even when the spring 43*a* is in a normal, partially compressed state. Thus, when compressed, the spring 43*a*, having a resultant spring force, will be pushing the latch release button 46 down. When the spring 43*a* is extended, there will be no force pushing the latch release button 46 down except the weight of the latch release button 46, which is not significant.

Figure 7C:
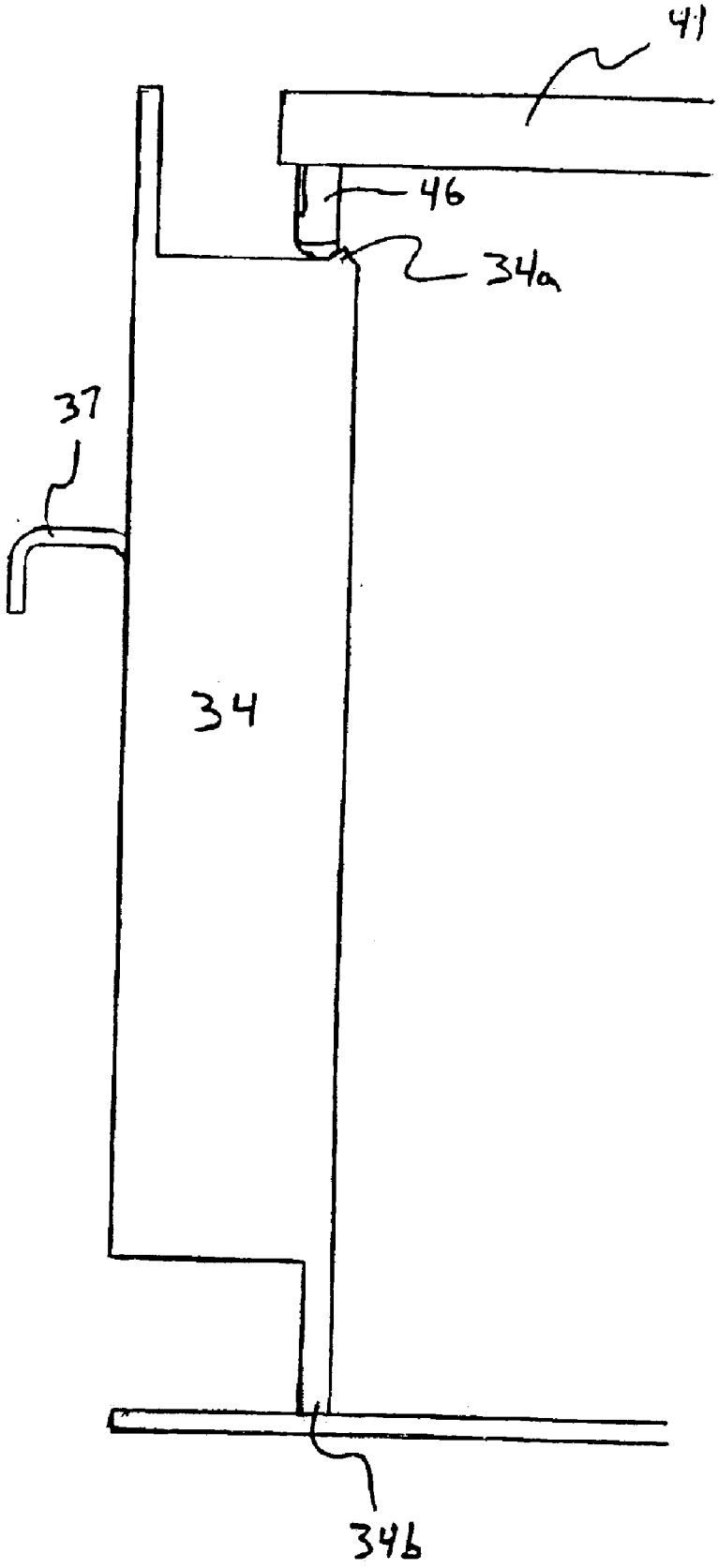
FIG. 7*c* is a side view of the mailbox door showing the latch release button in a down-position.
Figure 9:
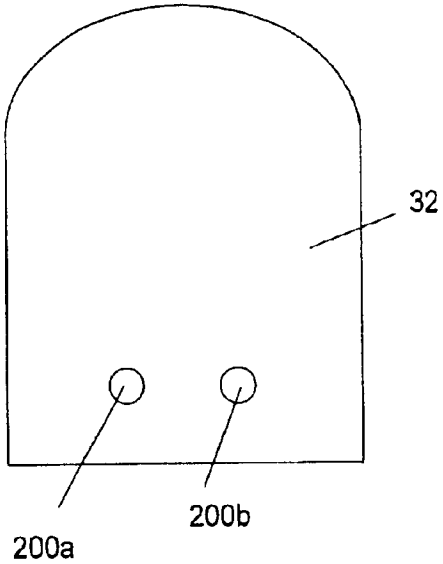
FIG. 9 is a rear view of the mailbox base showing the sensors.

Noting FIG. 7*c*, the mailbox door 34 may be opened manually or automatically as described above. When the latch mechanism 40 is not activated and in a "locked" position wherein the spring 43 is at least partially compressed and pushing the latch release button 46 downwards from the force of the nut means 42, any pulling force on the tab 37 will allow a raised lip 34*a* on the top of the mailbox door 34 to slightly push the latch release button 46 upwards and allow the mailbox door 34 to open. Alternatively, the mailbox door 34 is automatically released by the latch mechanism 40 when the latch mechanism 40 is activated and "unlocked" when the spring 43*a* is allowed to relax after the nut means 42 is pulled upwards. As a result of the relaxation of the spring 43*a*, the mailbox door 34 is permitted to fall downward because in the preferred embodiment the center of gravity of the mailbox door 34 is not aligned with the vertical axis of the hinge 34*b*. In the absence of a significant force of the latch release button 46 holding the raised lip 34*a* of the mailbox door 34 back, the mailbox door 34 will naturally swing open due to gravity. It can be envisioned that any type of opening assistance means may further be provided such as a spring-assist (not shown) provided at the bottom of the mailbox door.

The electrical power for the two actuators 60 and 61 may come from batteries, a transformer connected to an outlet, solar panels connected to a rechargeable device or other similar power source. The transparent areas 7 and opaque areas 8 of the mailbox cover sleeves 5 and 10 may further be thin enough to have a polarizing effect on light.

The electrical components of the mailbox control system are essentially made up of two major circuits, which convert the laser signal of the user to an electrical signal. The electrical signal then controls the operation of the actuators 60 and 61. The first of two major circuits is referred to as the latch mechanism circuit, which is represented by the sub-circuit schematics of FIGS. 12–16, and which controls the opening of the mailbox door 34. The second of the two circuits, which is designated by sub-circuit schematic FIGS. 17–21, and which is referred to as the inner sleeve position toggle circuit, controls the movement of the inner sleeve 10 position. Thus, each of these two circuits comprises multiple sub-circuits connected in series.

Figure 15:
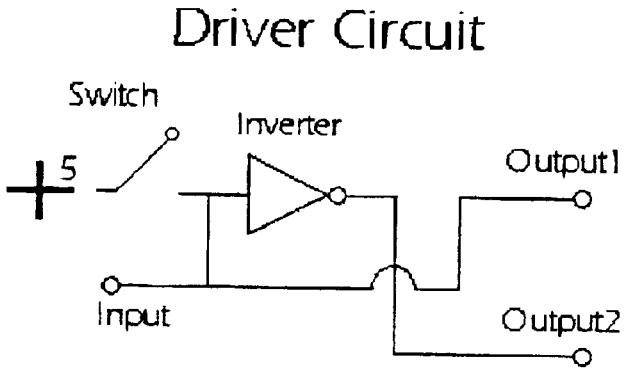
FIG. 15 is a diagram of the driver sub-circuit for the latch mechanism circuit.
Figure 16:
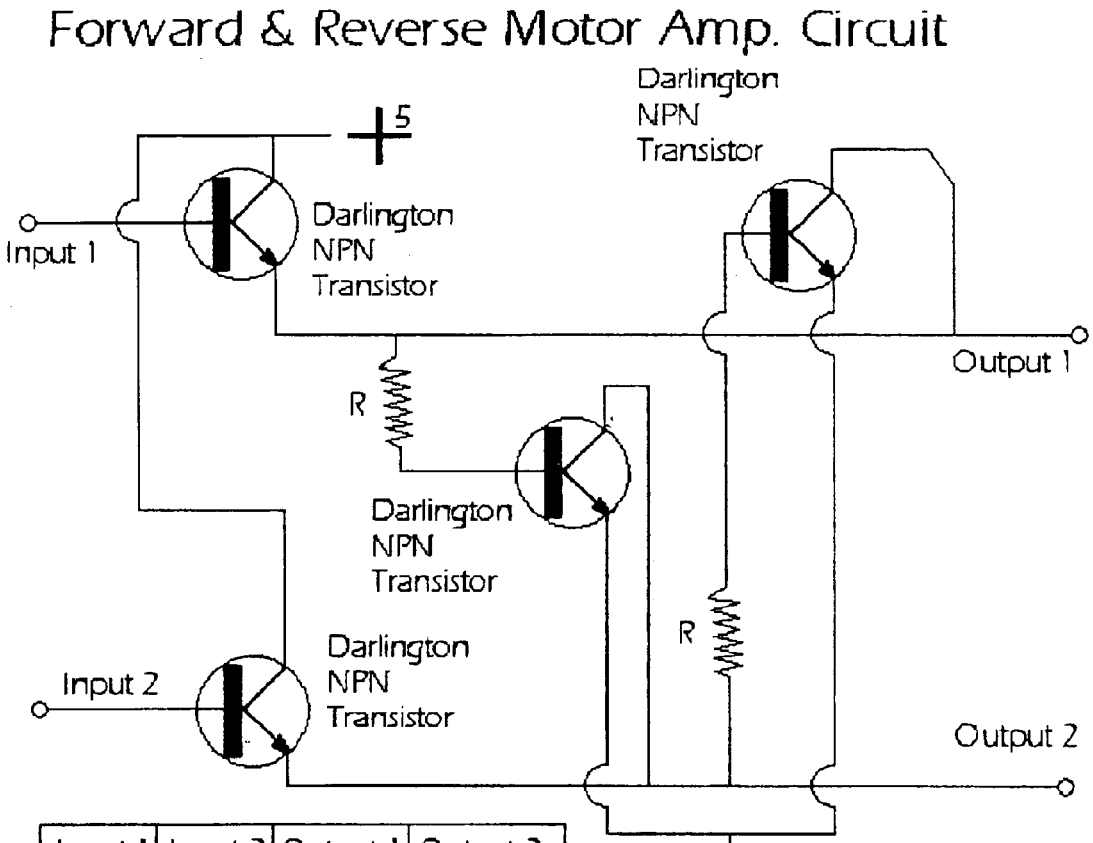
FIG. 16 is a diagram of the forward and reverse sub-circuit for the latch mechanism circuit.

The latch mechanism circuit comprises sub-circuits which include; a photo sub-circuit (FIG. 12), a positive signal debouncer sub-circuit (FIG. 13), a positive pulse generator sub-circuit (FIG. 14), a driver sub-circuit (FIG. 15), and a forward and reverse sub-circuit (FIG. 16).

Figure 20:
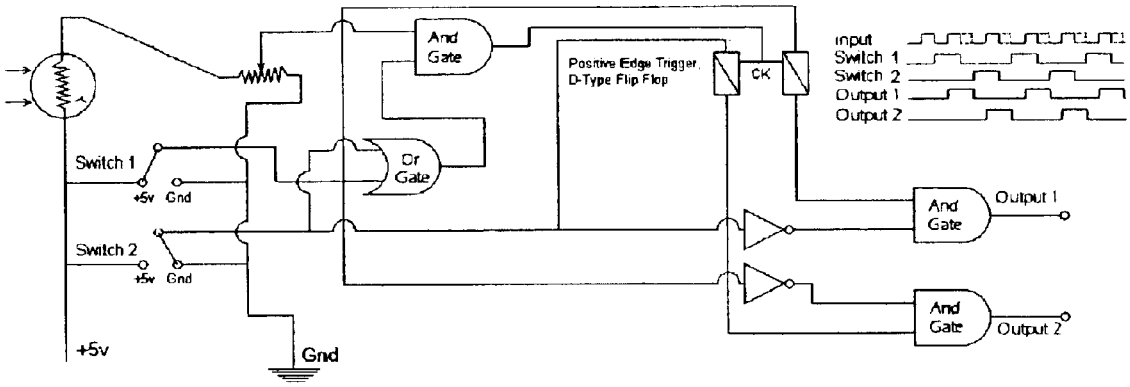
FIG. 20 is a diagram of the sleeve toggle sub-circuit for the inner sleeve position toggle circuit.
Figure 21:
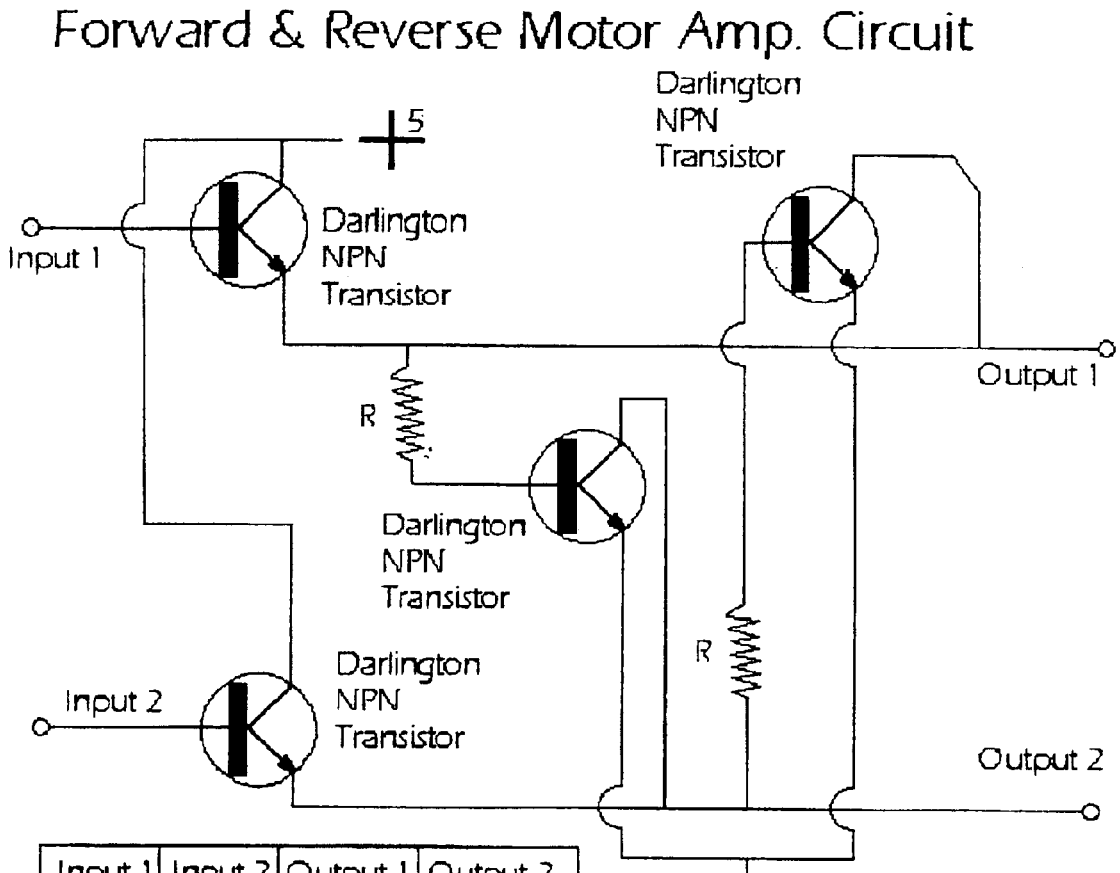
FIG. 21 is a diagram of the sleeve forward and reverse sub-circuit for the inner sleeve position toggle circuit.

The inner sleeve position toggle circuit comprises a plurality of sub-circuits as well, which include a sleeve photo sub-circuit (FIG. 17), a sleeve positive signal debouncer sub-circuit (FIG. 18), a sleeve positive pulse generator sub-circuit (FIG. 19), a sleeve toggle sub-circuit (FIG. 20), and a sleeve forward and reverse sub-circuit (FIG. 21).

First, referring to the mailbox latch mechanism circuit diagrams, the photo sub-circuit (FIG. 12) converts the laser's on/off signal, which is activated by the user, into an electrical signal that can be recognized by the control circuit. When the photo sub-circuit (FIG. 12) sees no laser light through the photo resistor, it sends out zero (0) voltage. When the photo sub-circuit (FIG. 12) sees strong laser light in the photo resister, indicating direct intentional activation by the user, it sends out a +5 volt signal to the rest of the circuit through the output terminal.

Figure 13:
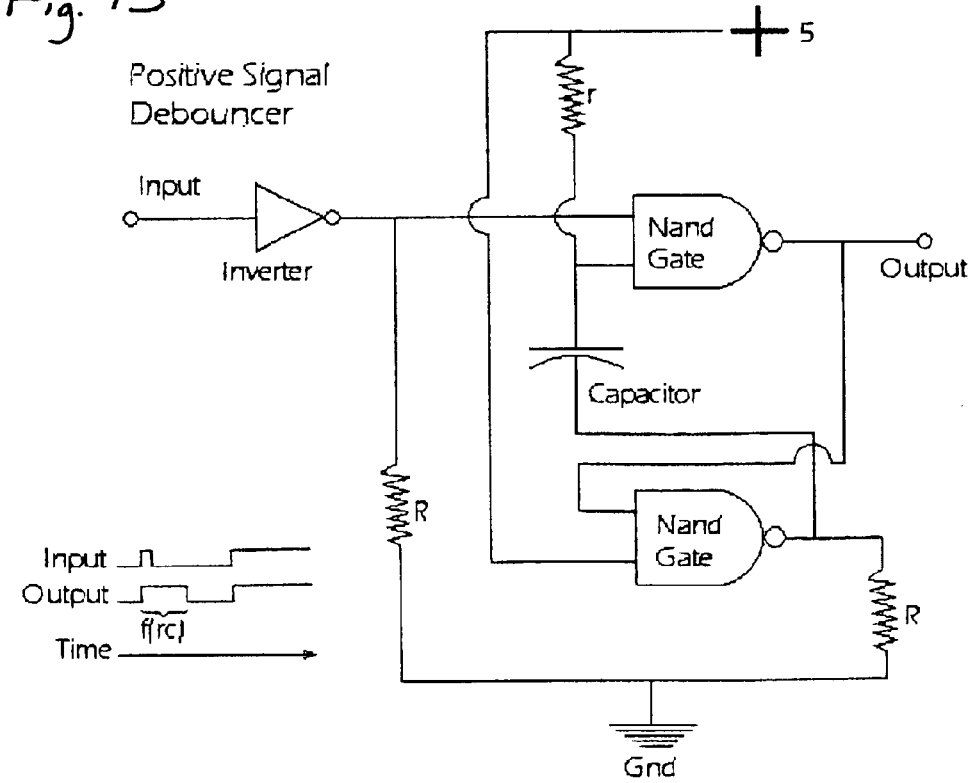
FIG. 13 is a diagram of the positive signal debouncer sub-circuit for the latch mechanism circuit.
Figure 14:
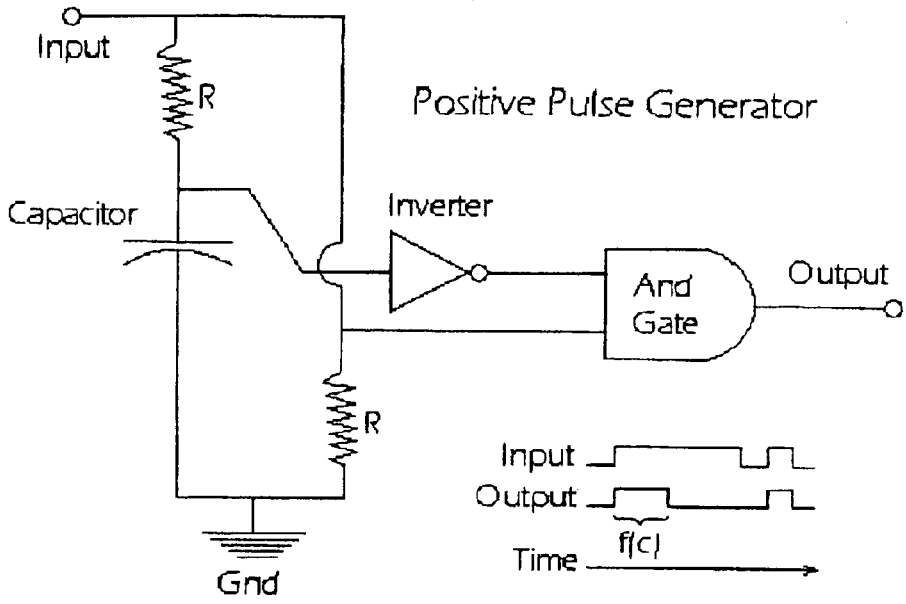
FIG. 14 is a diagram of the positive pulse generator sub-circuit for the latch mechanism circuit.

Now referring to FIG. 13, the positive signal debouncer sub-circuit receives the signal from the photo sub-circuit (FIG. 12) and converts it to a voltage pulse of +5 v which lasts for a predefined time. The predefined pulse is necessary for proper operation of this sub-circuit. This positive signal debouncer sub-circuit (FIG. 13) prevents the user from having to activate the laser for the full length of time in order to correctly activate the system. If the user releases the laser activation button 75*a* on the remote control 75, before the required time has passed, the positive signal debouncer sub-circuit (FIG. 13) continues to send the signal to the rest of the circuit, so that the control system will receive a signal of at least a certain time length. However, if the user continues to press the laser activation button 75*a* beyond the time needed for the mailbox control system to function, the positive signal debouncer sub-circuit (FIG. 13) discontinues the signal to the rest of the mailbox control system. Therefore, the pulse generator sub-circuit (FIG. 14) is needed to control the ending of the signal.

The positive pulse generator sub-circuit (FIG. 14) prevents an extra long signal from the user from becoming an extra long signal to the control system. The positive pulse generator sub-circuit (FIG. 14) accomplishes this task by cutting off the electronic signal sent to the rest of the system after a predefined period of time. When this sub-circuit is used with the positive signal debouncer sub-circuit (FIG. 13), the length of the electronic signal sent to the control systems will be of a predefined time period regardless of the length of the user's remote input signal. The positive signal debouncer sub-circuit (FIG. 13) guards against the user discontinuing the laser signal too soon by assuring that the signal sent to the rest of the circuit is of at least a certain length. The pulse-generator sub-circuit (FIG. 14) prevents the user from extending the signal too long by assuring that the signal sent to the rest of the circuit does not go beyond a certain length.

Figure 6A:
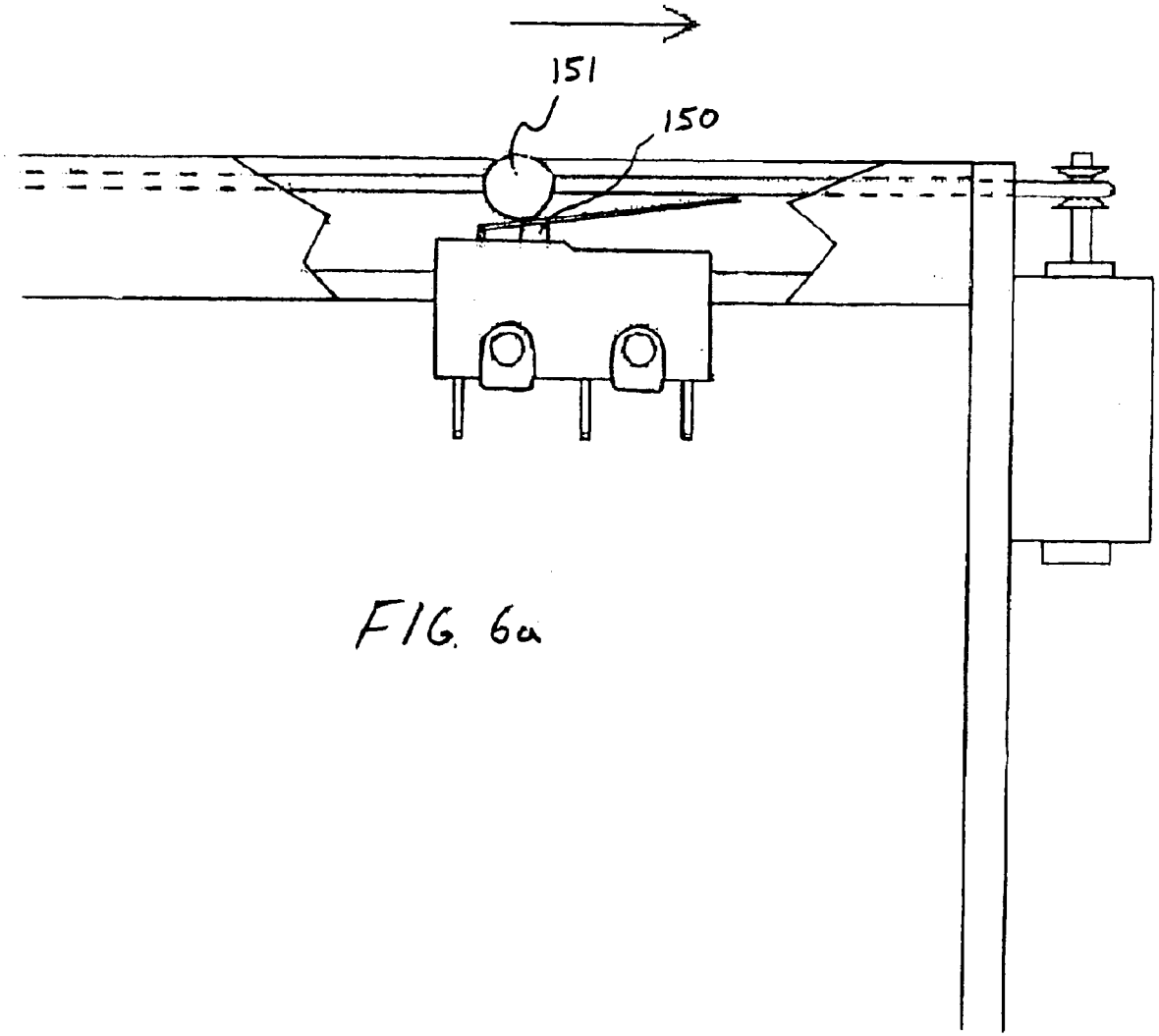
FIG. 6*a* is a broken view of the horizontal channel revealing a bead and switch embodiment for the pulley system.
Figures 6B, 6C:
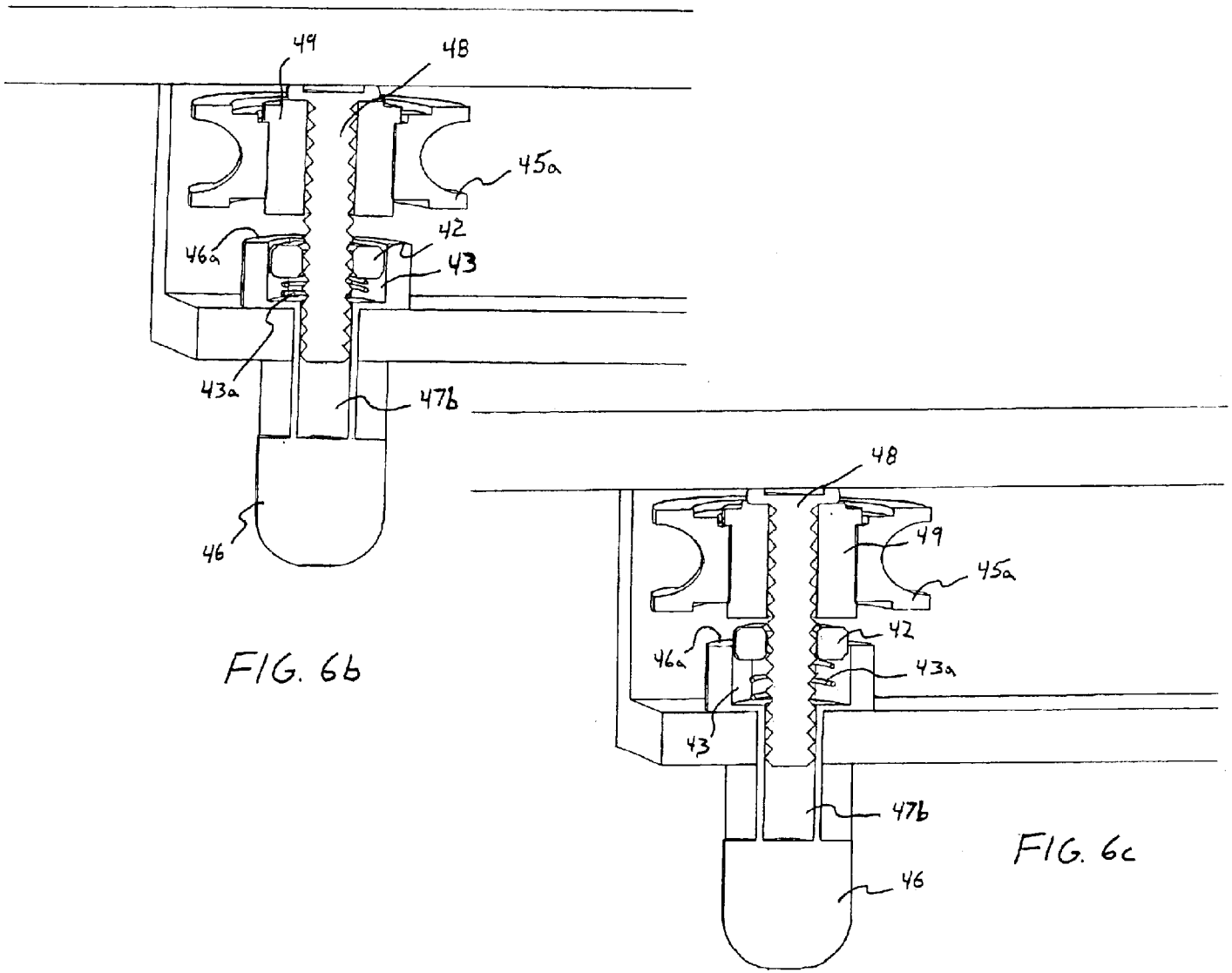
FIG. 6*b* is a cross-sectional view of the latch mechanism in a compressed position.
FIG. 6*c* is a cross-sectional view of the latch mechanism in an uncompressed position.

FIG. 15 shows the driver sub-circuit which receives the +5 v timed pulse from the positive pulse generator sub-circuit (FIG. 14), and uses it to activate the mailbox latch mechanism 40 through output 1. When the pulse from the positive pulse generator sub-circuit stops (FIG. 14), the driver sub-circuit will send a +5 v signal out of output 2 until the mailbox latch mechanism 40 is back in the full closed position. The driver sub-circuit (FIG. 15) is capable of sensing when the mailbox latch mechanism 40 is in the full closed position because the switch 150 (FIG. 6*a*) in the sub-circuit is closed by physical link to the latch mechanism 40. When the latch mechanism 40 is in the full closed position, it closes the switch 150 (FIG. 6*a*). When this switch 150 (FIG. 6*a*) is closed, it turns off the +5 v signal from output 2, and stops the second actuator 61 from continuing to try to reset the latch mechanism 40.

FIG. 16 describes the forward and reverse sub-circuit that receives the +5 v timed pulses from the driver sub-circuit (FIG. 15) through inputs 1 & 2, and uses these signals to control the second actuator 61 that activates the mailbox door 34 opening and closing mechanisms. When the forward and reverse sub-circuit (FIG. 16) sees a +5 v signal at input 1 and 0 v at input 2, it turns on output 1 and connects output 2 to ground voltage. Alternatively, when the forward and reverse sub-circuit (FIG. 16) sees a+5 v at input 2 and 0 v at input 1, it turns on output 2 and connects output 1 to ground. Each output terminal is connected directly to the terminals of second actuator 61, so that when they alternate between a +5 v and ground, they make the second actuator 61 turn in the forward or reverse direction. This sub-circuit completes the latch mechanism circuit.

Figure 17:
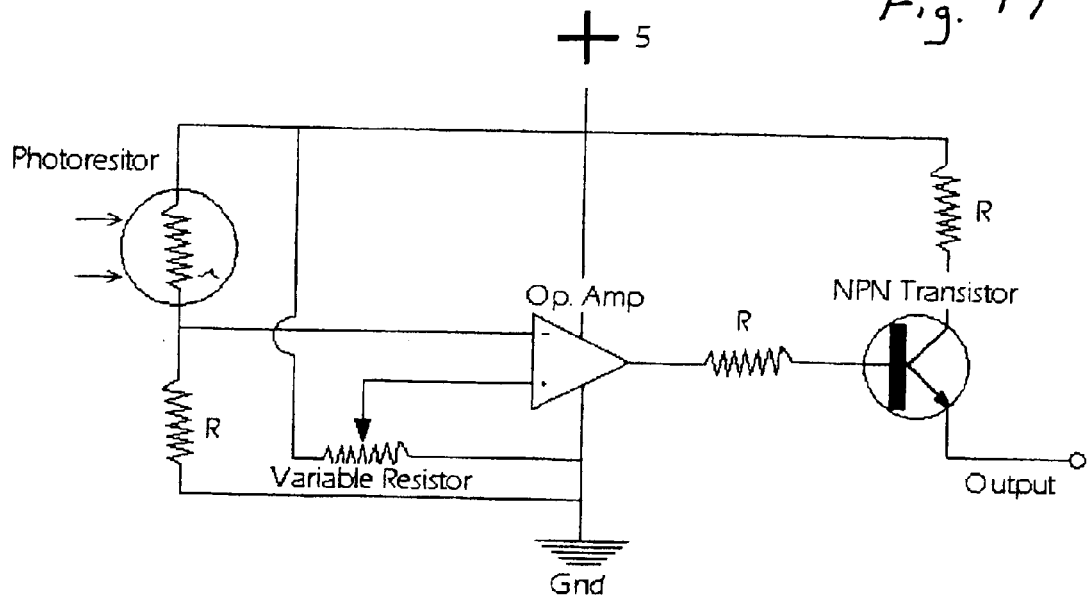
FIG. 17 is a diagram of the sleeve photo sub-circuit for the inner sleeve position toggle circuit.
Figure 17:
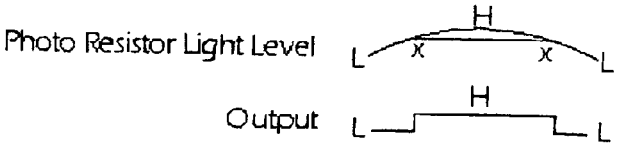

Now referring to the mailbox inner sleeve position toggle circuit, which can be seen in figures (17–21), FIG. 17 shows the sleeve photo sub-circuit which converts the laser's on off signal, activated by the user, into an electrical signal that can be recognized by the control circuit. When the sleeve photo sub-circuit (FIG. 17) sees no laser light, it sends out 0 voltage. When the sleeve photo sub-circuit (FIG. 17) sees strong laser light, indicting direct intentional activation by the user, it sends out a +5 v signal to the rest of the circuit through the output terminal.

Figure 18:
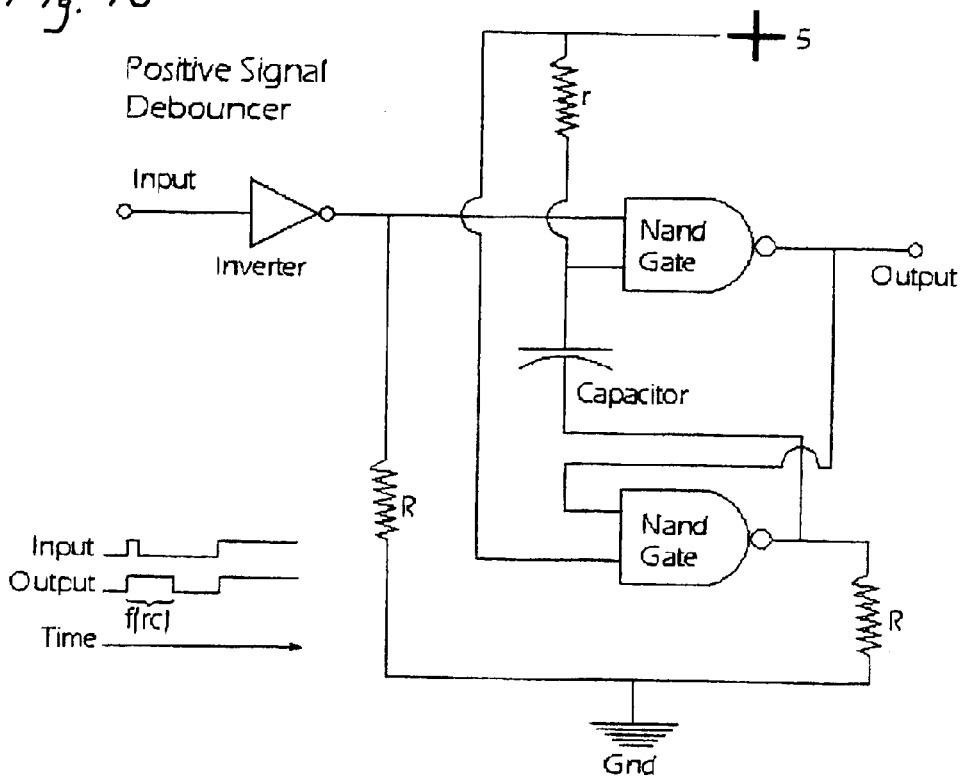
FIG. 18 is a diagram of the sleeve positive signal debouncer sub-circuit for the inner sleeve position toggle circuit.

Now with reference to FIG. 18, the mailbox control system requires signals of a specific time length in order to operate correctly. The sleeve positive signal debouncer sub-circuit (FIG. 18) receives the signal from the sleeve photo sub-circuit (FIG. 17) and converts it to a voltage pulse of +5 v which lasts for a predefined time. This sub-circuit prevents the user from having to activate the laser for the full length of time in order to correctly activate the system. If the user releases the laser activation button 75*a* on the remote control 75 before the required time has passed, this sleeve positive signal debouncer sub-circuit (FIG. 18) continues to send the signal to the rest of the circuit, so that the control system will receive a signal of at least a certain time length. However, if the user continues to press the laser activation button on the remote control 75 beyond the time needed for the mailbox control system to function, this sub-circuit discontinues' the signal to the rest of the mailbox control system. Therefore, the sleeve positive pulse generator sub-circuit (FIG. 19) is needed to control the ending of the laser signal.

Figure 19:
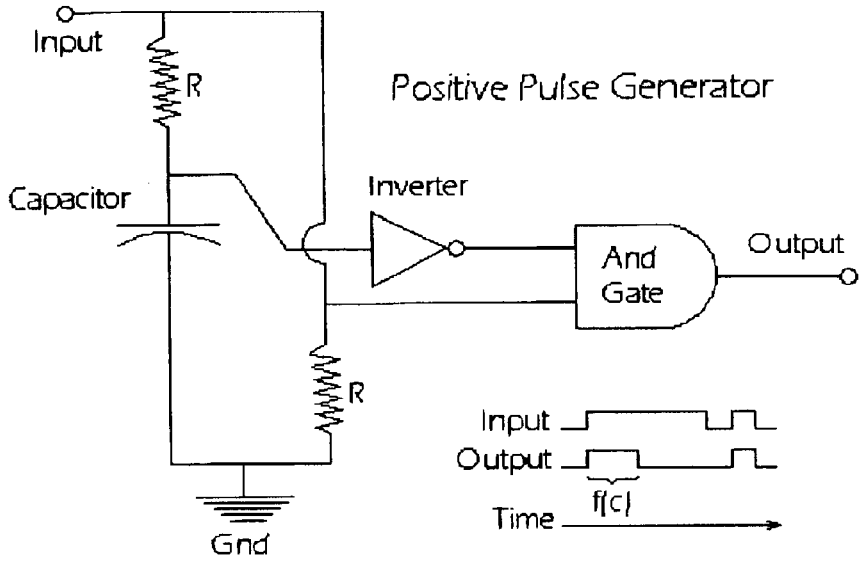
FIG. 19 is a diagram of the sleeve positive pulse generator sub-circuit for the inner sleeve position toggle circuit.

The positive pulse generator sub-circuit, shown in FIG. 19, prevents an extra long signal from the user from becoming an extra long signal to the control system. The sleeve positive pulse generator sub-circuit (FIG. 9) accomplishes this objective, by cutting off the electronic signal sent to the rest of the system after a predefined period of time. When this sub-circuit is used with the sleeve positive signal debouncer sub-circuit (FIG. 19), the length of the electronic signal sent to the control system will be of a predefined time period regardless of how long the user inputs the laser remote signal. The positive signal debouncer sub-circuit (FIG. 18) guards against the user discontinuing the signal too soon by assuring that the signal sent to the rest of the circuit is of at least a certain length, and the sleeve positive pulse generator sub-circuit (FIG. 19) prevents the user from extending the signal too long by assuring that the signal sent to the rest of the circuit does not go beyond a certain length.

As shown in FIG. 20, the sleeve toggle circuit receives the +5 v timed signals from the sleeve signal debouncer sub-circuit (FIG. 19) and alternatively sends out a correspondingly timed +5 v signal from outputs 1 or 2.

The sleeve forward and reverse sub-circuit (FIG. 21) receives the +5 v timed pulses from the sleeve toggle sub-circuit (FIG. 20) through inputs 1 and 2, and uses these signals to control the first actuator 60 that controls the movement of the inner sleeve 10. When the sleeve forward and reverse sub-circuit (FIG. 21) sees a +5 v signal at input 1 and 0 v signal at input 2, it activates output 1 and connects output 2 to ground voltage. Alternatively when the forward and reverse sub-circuit sees a +5 v at input 2 and 0 v at input 1, it activates output 2 and connects output 1 to ground. Each output terminal is connected directly to the first actuator's 60 terminals. When the terminals alternate between +5 v and ground, they make the first actuator 60 turn in the forward and reverse direction. This sub-circuit completes the mailbox inner sleeve toggle circuit.

Figure 10:
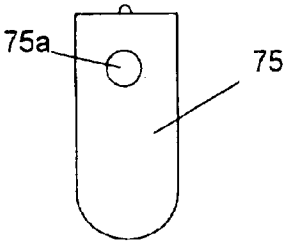
FIG. 10 is a top view of an example of the remote control device.
Figure 8:
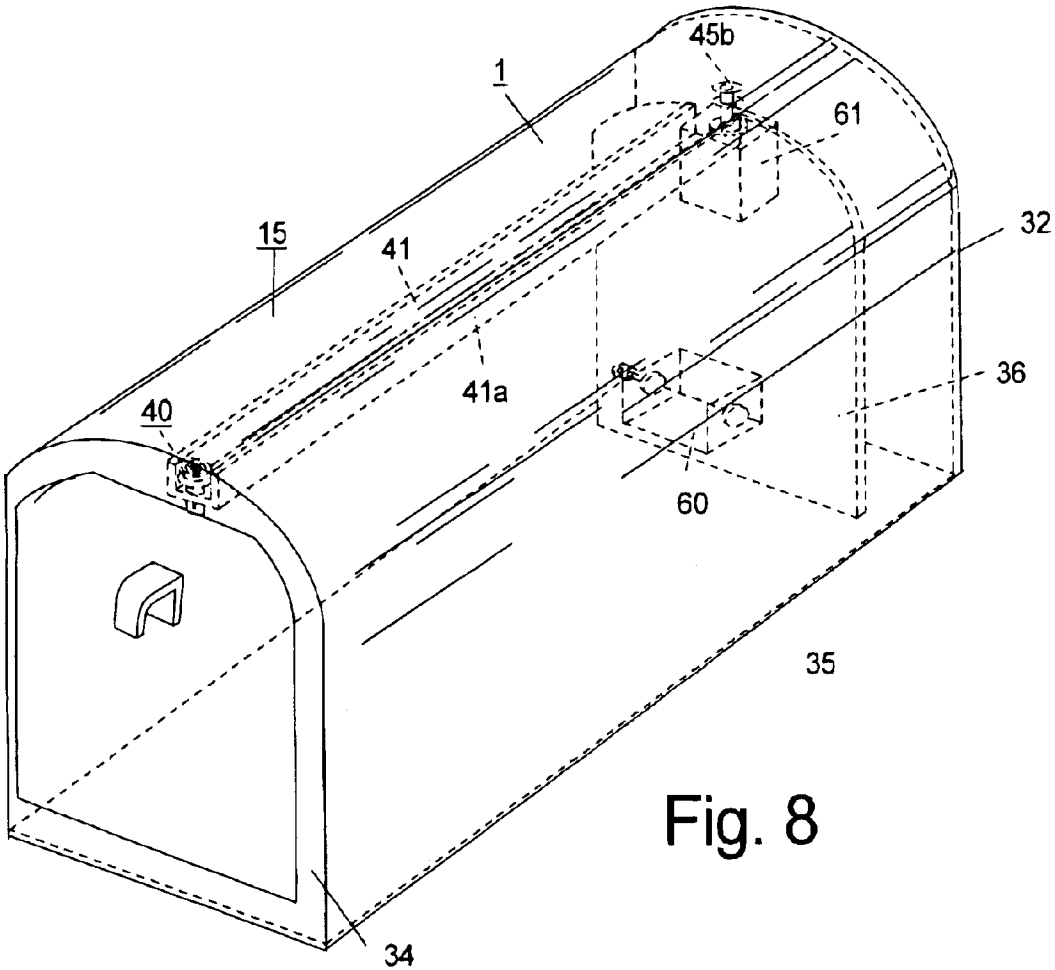
FIG. 8 is a perspective view of the mailbox when completely assembled.
Figure 11:
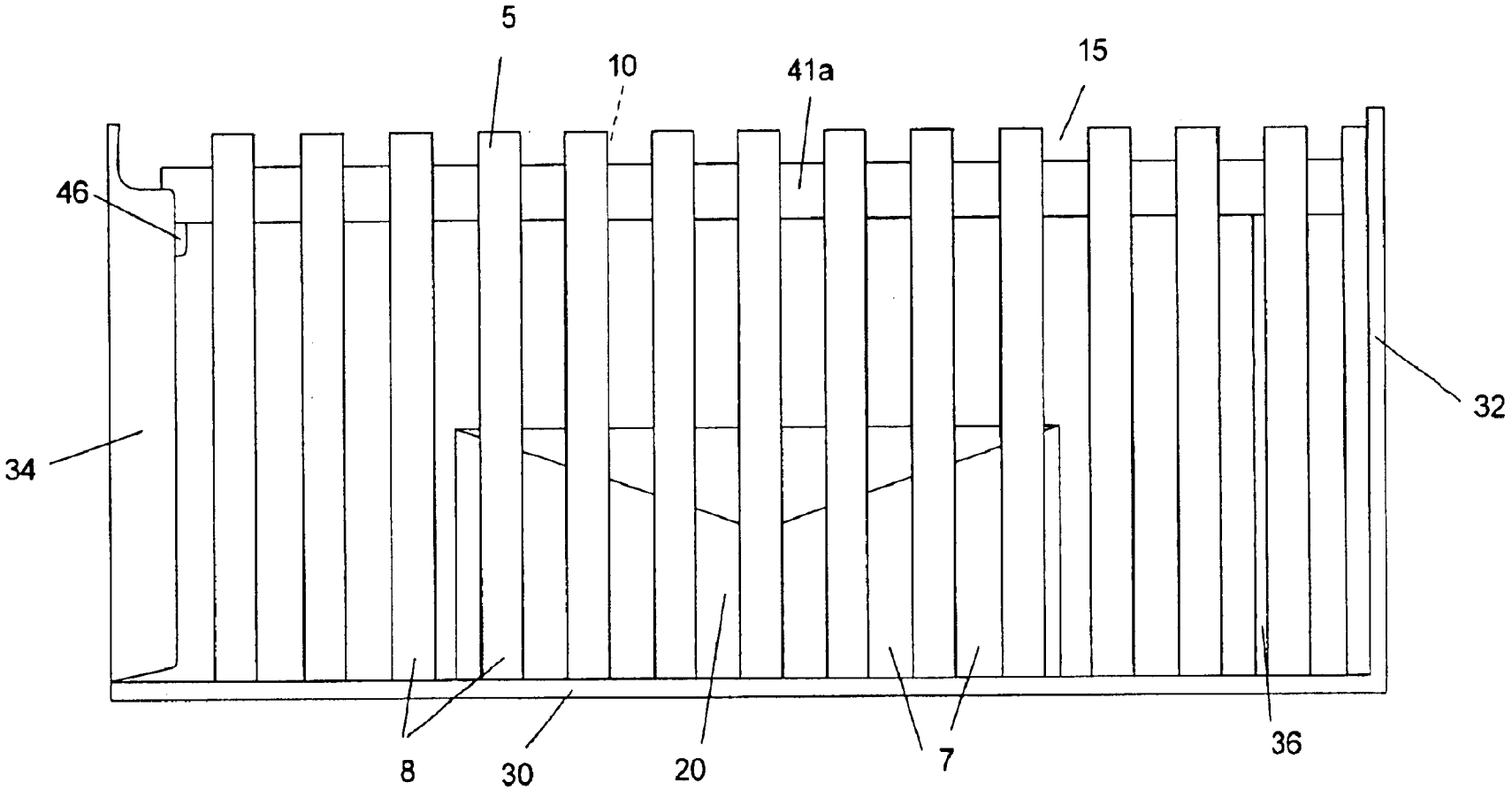
FIG. 11 is a side view of the mailbox cover when the outer and inner sleeves are aligned to reveal the contents of the interior.
Figure 12:
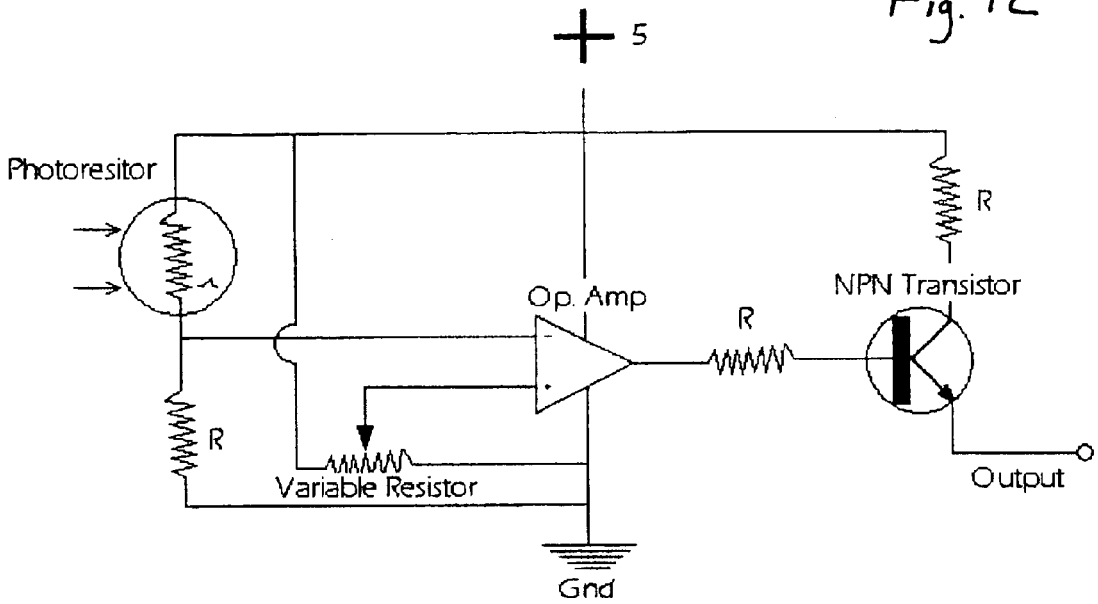
FIG. 12 is a diagram of the photo sub-circuit for the latch mechanism circuit.
Figure 12:
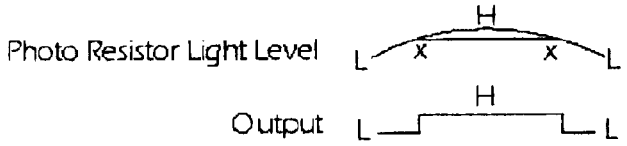

In use, the security mailbox 1 would receive mail as any conventional mailbox would. The person depositing the mail would pull the tab 37 on the front of the mailbox door 34 to open the door 34, deposit their mail, and close the door 34 by pushing it shut. The owner of the mailbox 1 has a laser remote control 75 to use with the security mailbox 1, as shown in FIG. 10.

Laser light has the ability to travel long distances without spreading out. This enables the owner of the mailbox 1 to use the remote control 75 from a considerable distance away from the mailbox 1. When the electronics receive a signal from the first sensor port 200*a*, they energize the first actuator 60, which is connected to the inner sleeve 10. This first actuator 60 moves the inner sleeve 10 slightly so that the transparent 7 and opaque 8 areas on the inner sleeve 10 now match up, or at least partially align with the transparent 7 and opaque 8 areas of the outer sleeve 5. Since the transparent 7 and opaque 8 areas between the areas of the outer sleeve 5 are no longer covered by the areas of the inner sleeve 10, but now line up with the areas of the inner sleeve 10, it is now possible for the owner to approach and view the contents 20 of the mailbox 1 from the side. Another signal from laser activation button of the remote control 75 to the same sensor port 200*a* causes the mailbox 1 to convert back to its opaque state, by causing the first actuator 60 to move the inner sleeve 10 back to its original position.

Now that the owner of the mailbox 1 knows the contents 20 of the mailbox 1, the owner now needs to retrieve the contents 20. The owner will use the remote control 75 to signal the second port sensor 200*b*. Due to the fact that the remote control 75 uses laser light, the owner can be quite a distance away from the mailbox 1 when signaling the second sensor port 200*b*. When a signal is received by the second sensor port 200*b* at the back of the mailbox 1, the second actuator 61 is energized, and the mailbox door latch mechanism 40 is released.

We claim:

1. A security mailbox, comprising:

a base;

a top cover mounted on said base, wherein said top cover further comprises:

an inner sleeve and an outer sleeve, each said sleeve comprised of a major body portion having a pattern of alternating transparent and opaque areas, wherein said inner sleeve underlies said outer sleeve and is adapted to be displaced horizontally on said base such that said pattern of alternating transparent and opaque areas on said inner sleeve may respectively align with said pattern of alternating transparent and opaque areas of said outer sleeve to allow a partial view into an interior of said top cover; and a means for horizontally displacing said inner sleeve.

2. The security mailbox of claim 1, wherein said alternating transparent and opaque areas of each said sleeve are congruent.

3. The security mailbox of claim 1, further comprising a door hingedly attached to a front of said base.

4. The security mailbox of claim 3, further comprising a means for remotely unlatching said door.

5. A security mailbox, comprising:

a base;

a door hingedly attached to a front of said base;

a latch mechanism situated within a horizontal channel proximate to said door, further comprising:

a latch release button extending through said horizontal channel comprising a cavity in a top thereof, a screw extending through said cavity, a pulley integrally attached to said screw, a nut means disposed within said cavity encircling said screw, and a spring underlying said: nut means within said cavity, wherein said latch release button is configured to move upwards in response to a force of said door as said spring is in a relaxed state when said nut means moves upwards upon rotation of said pulley.

6. The security mailbox of claim 5, wherein said pulley is rotated by a flexible linkage attached to a drive pulley of an actuator.

7. The security mailbox of claim 6, wherein said actuator is positioned proximate to a back of said base such that said flexible linkage travels a length of said horizontal channel.

8. The security mailbox of claim 5, wherein said latch release button further comprises a means for prohibiting rotation of said latch release button within said horizontal channel.

9. The security mailbox of claim 5, wherein said door further comprises a raised lip portion integrally formed on a top thereof for abutting said latch release button.

10. A security mailbox, comprising:

a base having a perpendicular back;

an inner sleeve and an outer sleeve mounted on said base;

a horizontal channel defined in a rail underlying said inner sleeve;

a latch mechanism situated within said horizontal channel;

a first actuator for toggling a position of said inner sleeve attached via a wound flexible linkage to an inside of said inner sleeve; and a second actuator having a small drive pulley for driving said latch mechanism and positioned such that said small drive pulley is in alignment with said horizontal channel.

11. The security mailbox of claim 10, further comprising a means positioned on said perpendicular back for detecting a light signal such that said first actuator and said second actuator may be activated.

12. The security mailbox of claim 11, further comprising a remote controller for producing said laser light signal.

13. The security mailbox of claim 10, further comprising a lever-activated switch positioned within said horizontal channel.

14. The security mailbox of claim 13, wherein said lever-activated switch is configured to be closed by a bead attached to said flexible linkage.

15. A security mailbox, comprising:

a base having a perpendicular back;

an inner sleeve and an outer sleeve mounted on said base;

a horizontal channel defined in a rail underlying said inner sleeve;

a latch mechanism situated within said horizontal channel;

a control board attached to said base;

a circuit means for converting a laser light signal to an electrical signal, wherein said electrical signal is used to toggle a position of said inner sleeve and used to activate said latch mechanism.

16. The security mailbox of claim 15, further comprising a remote controller for producing said laser light signal.

17. The security mailbox of claim 15, further comprising a sensing means positioned on said perpendicular back for detecting said laser light signal.

18. The security mailbox of claim 15, wherein said circuit means further comprises a means for preventing a user from having to activate said laser light signal for a predefined length of time.

* * * * *